United States Patent [19]

Nelson

[11] Patent Number: 4,891,613

[45] Date of Patent: Jan. 2, 1990

[54] TRANSFER DEVICE FOR COMBINING, DIVIDING, AND SWITCHING MICROWAVE SIGNALS

[76] Inventor: Victor Nelson, 8 Midvale Ct., East Northport, N.Y. 11731

[21] Appl. No.: 294,829

[22] Filed: Jan. 9, 1989

[51] Int. Cl.[4] ..... H01P 1/12

[52] U.S. Cl. ..... 333/108; 333/259

[58] Field of Search ..... 333/101, 105, 108, 259, 333/258; 335/4, 5

[56] References Cited

U.S. PATENT DOCUMENTS

| | | | |
|---|---|---|---|
| 2,955,268 | 10/1960 | Riblet | 333/259 |
| 3,440,577 | 4/1969 | Pappalardo | 333/259 |
| 4,618,840 | 10/1986 | Yee et al. | 333/105 |

FOREIGN PATENT DOCUMENTS

| | | | |
|---|---|---|---|
| 2036042 | 4/1978 | Fed. Rep. of Germany | 333/259 |

*Primary Examiner*—Paul Gensler

*Attorney, Agent, or Firm*—Edward H. Loveman

[57] ABSTRACT

This microwave transfer device is a hollow body having an internal cavity and lateral input and output openings communicating with the cavity. A post in the cavity divides it into passages extending between input and output openings for passing microwave signals therebetween. Axially reciprocatable shorting pins are supported on the body and are selectively insertable in the passages to close off the passages, and retractable from the passages to open the same. By proper selective insertion and retraction of the pins, microwave signals applied at the input openings can be combined, divided, or switched, respectively, to the output openings.

10 Claims, 3 Drawing Sheets

TRANSFER DEVICE FOR COMBINING, DIVIDING, AND SWITCHING MICROWAVE SIGNALS

BACKGROUND OF THE INVENTION

1. Field of the Invention

This invention relates to the art of transfer devices used to combine, divide, and switch microwave signals traveling in different paths to and from microwave antennas, transmitters, receivers and other microwave loads; and more particularly concerns a small, simple, efficient, lightweight, transfer device operated by selective movement of shorting pins or plungers into and out of multiple microwave signal paths, to choose to open and close the several paths thereby combining, dividing or switching the microwave signals.

2. Description of the Prior Art

Heretofore, microwave transfer devices used as combiner and dividers have been rather large, heavy, complicated, expensive assemblies generally fixed in parameters so that they could not be switched from one microwave path to another. The prior combiners and dividers have not been capable of operating simply as switches. For such applications, special microwave switch assemblies had to be provided.

SUMMARY OF THE INVENTION

It is a principal object of the present invention to provide a single microwave transfer assembly which can operate selectively as a switchable combiner, divider, and/or switch. Another object is to provide a device of the type described which operates faster, and more efficiently than prior devices of this type. According to the invention, there is provided in the device a microwave transfer or distribution unit in which is a plurality of paths for microwaves intended to be transmitted to and from interconnected antennas, between associated transmitters, receivers, and/or other microwave loads. The wave distribution unit is provided with an associated shorting pin assembly for selectively inserting shorting pins or plungers into the several microwave paths in the distribution unit. The pins are movable electromagnetically or mechanically by solenoids, motors, or mechanical transmission means.

These and other objects and many of the attendant advantages of this invention will be readily appreciated as the same becomes better understood by reference to the following detailed description when considered in connection with the accompanying drawings in which:

DESCRIPTION OF THE PREFERRED EMBODIMENT

Figure 1:
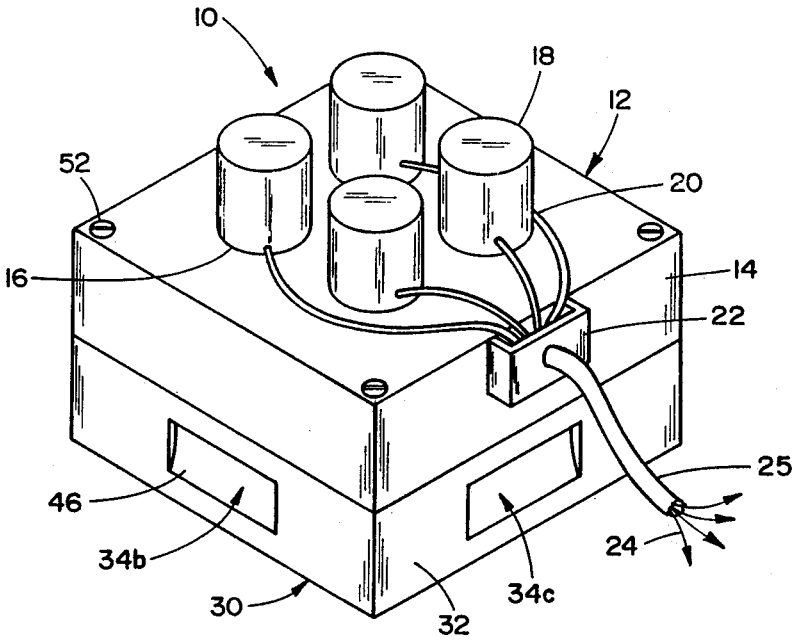
FIG. 1 is a simplified external perspective view of a microwave transfer assembly or device embodying the invention.
Figure 2:
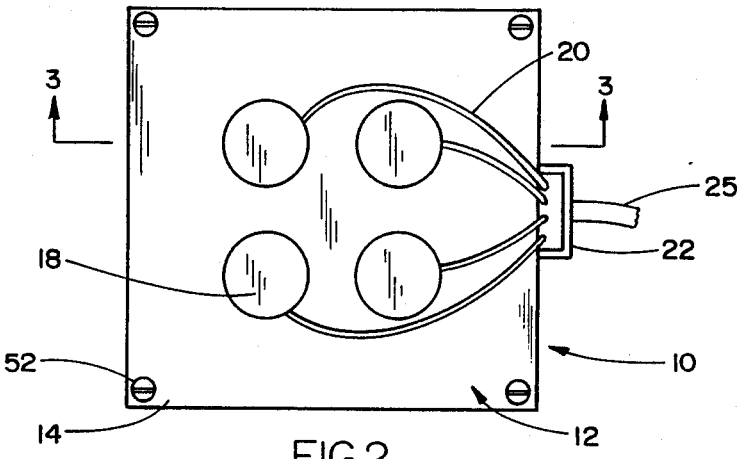
FIG. 2 is a top plan view of the assembly of FIG. 1.
Figure 3:
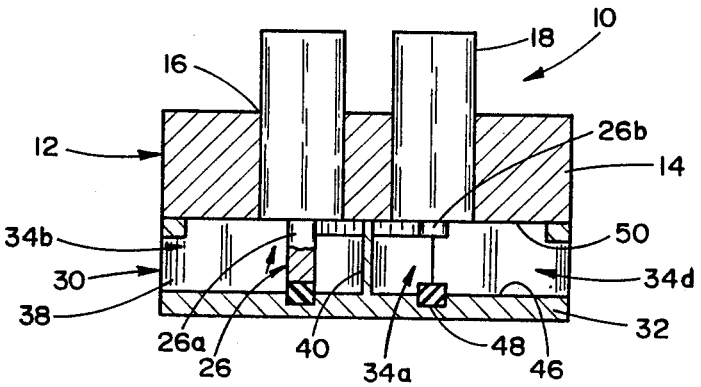
FIG. 3 is a cross sectional view taken along line 3—3 of FIG. 2.
Figure 4:
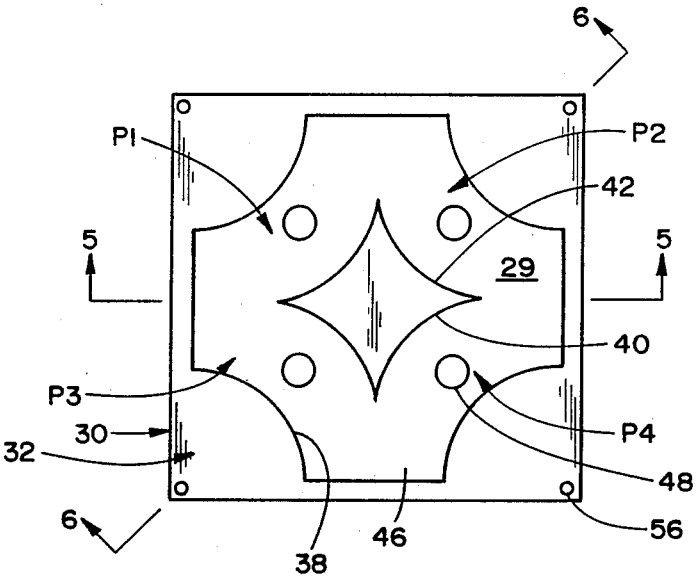
FIG. 4 is a top plan view of a microwave distribution unit employed in the assembly of FIGS. 1–3.
Figure 5:
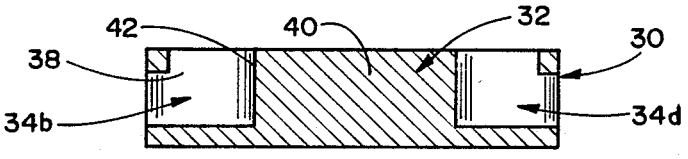
FIG. 5 is a central, transverse or cross sectional view taken along line 5—5 of FIG. 4.
Figure 6:
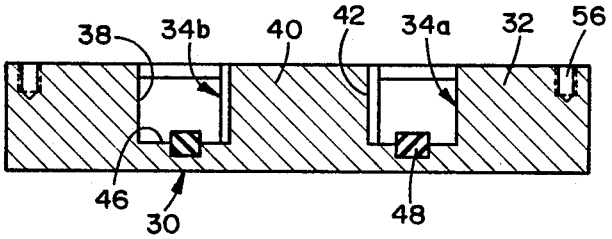
FIG. 6 is a diagonal, vertical, cross sectional view taken along line 6—6 of FIG. 5.
Figure 7:
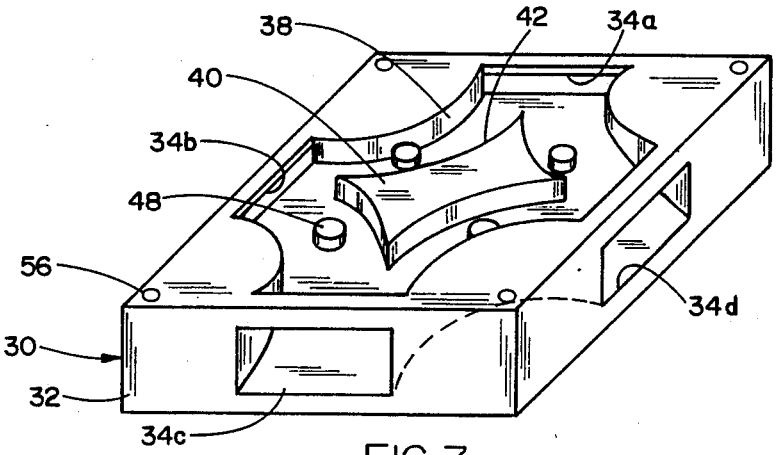
FIG. 7 is a perspective view of the unit of FIGS. 4–6.

Referring now to the drawings wherein like reference characters designate like or corresponding parts throughout, there is illustrated in FIGS. 1, 2 and 3, a microwave assembly generally designated as numeral 10, which has an upper unit 12 comprising a plate 14 in which are four axially parallel, spaced bores 16. In each of the bores 16 is a cylindrical solenoid 18 energized via a cable 20 connected to an external terminal box 22 in direct communication with a wire 24 of the cable 25. The wire 24 terminates at a control station (not shown) used to selectively energize the solenoids 18. In each of the solenoids is an axially movable pin or plunger 26, which can be selectively extended or retracted with respect to the solenoids 18.

Figure 8:
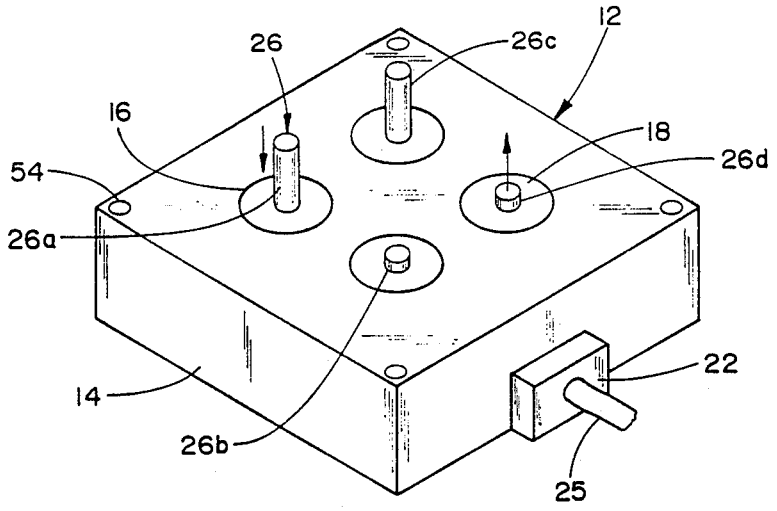
FIG. 8 perspective view of a pin driving unit employed in the assembly of FIGS. 1–3, the unit being shown in an inverted position.
Figure 10:
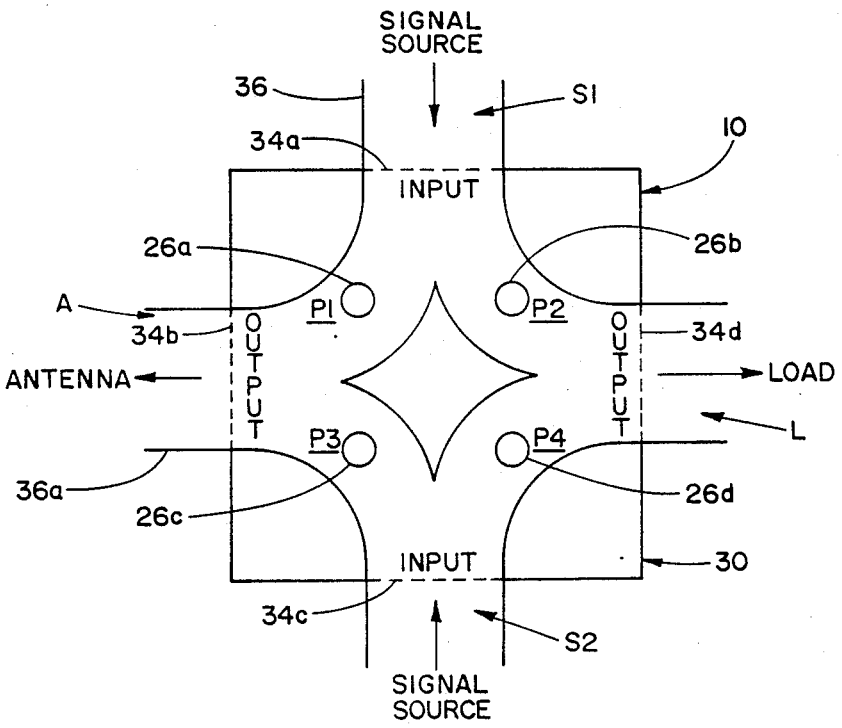

Assembly 10 further includes a microwave distribution or transfer unit 30, as best illustrated in FIGS. 4–7, which has a hollow body such as a plate 32 provided with four lateral openings or ports 34*a*, 34*b*, 34*c*, and 34*d*, to each of which may be connected a waveguide 36, indicated schematically in FIG. 10. The ports 34 communicate with an interior cavity 29 of the unit 30 n which are four curved paths P1, P2, P3 and P4. The paths are defined between smooth interior convex walls 38 and a central post 40 having smooth concave walls 42. Path P1 extends between the ports 34*a* and 34*b*. Path P2 extends between the ports 34*a* and 34*d*. Path P3 extends between the ports 34*b* and 34*c*, and path P4 extends between the ports 34*c* and 34*d*. If desired, a dielectric spacer 48, which serves as an abutment for a shorting pin 26, may be located on a bottom wall 46 of the cavity 29, at the center of each path. When a pin such as a pin 26*a* or 26*c* shown in FIGS. 3 and 8 is fully extended its free end abuts the associated spacer 48 which then serves as a stop member. In this position the extended pin blocks or shorts the microwave path into which it projects so that no microwave signal can pass. When a pin such as a pin 26*b* or 26*d* is in the retracted position (shown FIGS. 3 and 8), then the associated microwave path is clear to pass microwaves therethrough. An upper side 50 and the lower or bottom sides or walls 46 of the cavity 29 as well as the lateral sides or walls 38 and 42 are made of highly polished, highly conductive metallic material to minimize impedance to the microwaves. The pins 26 are also made of metal. The bottom of the plate 14 serves as the upper wall 50 of the cavity 29 and paths P1–P4. The two plates 14 and 32 can be secured together by a plurality of screws 52 each inserted in a respective hole 54 in the plate 14, and threaded into a respective threaded hole 56 in the plate 32. Paths P1–P4 are equal in length and in cross sectional area to present the same impedance to the microwaves in the passages.

The plates 14 and 32 are shown as square in form. However, these plates may have any other suitable geometrical shape such as cylindrical, rectangular. etc. The pins 26, shown as straight and cylindrical, may also have any suitable geometrical shape other than the round form shown, such as square, rectangular, oval, etc.

The particular configuration of the assembly 10 as illustrated in FIGS. 1–8 may have a plurality of operating conditions which will be explained with reference to the following tables I and II, and to FIGS. 9 and 10. As shown in FIG. 10 two of the openings 34a and 34c are designated as input openings for receiving microwave signals from signal sources S1 and S2. The two alternate, adjacent openings 34b and 34d are designated as output openings for driving an antenna, receiver, dummy load, etc. Appropriate wave guides 36, 36a are connectable to external side walls of the unit 30 at the openings 34a–34d. The shorting pins 26a–26d may be inserted or extended into and retracted from the centers of the passages P1–P4 respectively. The passages as mentioned above are of equal length and cross sectional area so that they present equal minimum impedances to microwave signals passing through the passages.

Figure 9:
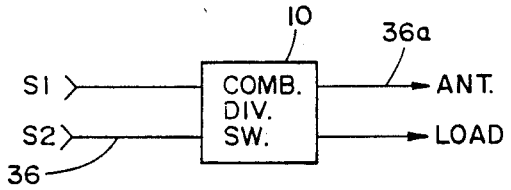
FIGS. 9 and 10 are diagrams used in explaining the operation of the assembly or device of FIGS. 1–3.

FIG. 9 illustrates the general arrangement of a circuit in which the device 10 is used. Two microwave signals S1 and S2 of equal frequency and phase are applied via the wave guides 36 to the input openings of the device 10. These signal sources can be receiving antennas and/or microwave transmitters.

Two microwave load devices are connected via the waveguides 36a to the two output openings of the device. These load devices may include an antenna, a receiver, a dummy load, and the like.

TABLE I

| OPERATING CONDITION | FUNCTION | INPUTS | OUTPUT |
|---|---|---|---|
| #1 | C | S1 + S2 | A |
| #2 | C | S1 + S2 | L |
| #3 | S | S1 | A |
| — | | S2 | L |
| #4 | S | S2 | A |
| | | S1 | L |
| #5 | D | S1 | A,L |
| #6 | D | S2 | A,L |
| #7 | S | S1 | A |
| #8 | S | S1 | L |
| #9 | S | S2 | A |
| #10 | S | S2 | L |
| #11 | C | S1 + S2 | L,A |
| #12 | S | OFF | OFF |

TABLE II

| OPERATING CONDITION | FUNCTION | PIN POSITIONS 26a | 26b | 26c | 26d | INPUT | OUTPUT | PATHS |
|---|---|---|---|---|---|---|---|---|
| #1 | C | R | EX | R | EX | S1 + S2 | A | P1,P3 |
| #2 | C | EX | R | EX | R | S1 + S2 | L | P2,P4 |
| #3 | S | R | EX | EX | R | S1 | A | P1 |
| | | | | | | S2 | L | P4 |
| #4 | S | EX | R | R | EX | S1 | L | P2 |
| | | | | | | S2 | A | P3 |
| #5 | D | R | R | EX | EX | S1 | A,L | P1,P2 |
| #6 | D | EX | EX | R | R | S2 | A,L | P3,P4 |
| #7 | S | R | EX | EX | EX | S1 | A | P1 |
| #8 | S | EX | R | EX | EX | S1 | L | P2 |
| #9 | S | EX | EX | R | EX | S2 | A | P3 |
| #10 | S | EX | EX | EX | R | S2 | L | P4 |
| #11 | C | R | R | R | R | S1,S2 | A,L | P1-P4 |
| #12 | S | EX | EX | EX | EX | OFF | OFF | OFF |

Table I lists twelve operating conditions #1–#12 for the microwave transfer device 10. The functions, namely: combining C, dividing D, and switching S are stated for each operating condition. The input signal sources S1 and/or S2 for each operating condition are stated as well as the outputs such as antenna A and/or load L.

Table II again lists the twelve operating conditions #1–#12 and the functions C (combining), D (dividing), and S (switching) which correspond to the listings in Table I. Table II also lists the particular positions for the several shorting pins 26a–26d at the several passages P1-P4 respectively. When the pin is extended as indicated by entry EX it will close its associated passage electrically to block passage of microwave signals therethrough. When the pin is retracted as indicated by entry R the associated passage will be clear electrically or opened to permit microwave signals to pass freely through the passage between the input opening at one end of the passage and the output opening at the other end of the passage. The output A or L for each operating condition corresponds to the listing in Table I.

It will be apparent from the foregoing that there has been provided a relatively simple, lightweight, rugged, versatile microwave transfer and distribution device for selectively passing microwave signals from inputs to outputs, and selectively combining, dividing and switching the microwave signals in the several passages, depending on the selective positions of the shorting pins in the passages.

Although the unit 30 has been illustrated as rectangular it can have other shapes provided that in each case the passages are all of equal length and configuration to insure that the microwave signals are subject to equal inpedances.

In practical usage the transfer device can distribute microwave signals of about 4000 MHz to about 15000 MHz, depending on the overall size of the device. For an operating frequency range of 14000 MHz to 14500 the transfer device body 32 be about four inches in length and width, and may have a power handling capacity of about 2000 watts.

It should be understood that the foregoing relates to only preferred embodiments of the invention which have been by way of example only and that it is intended to cover all changes and modifications of the example of the invention herein chosen for the purpose of the disclosure, which do not constitute departures from the spirit and scope of the invention.

What is claimed is:

1. A microwave transfer device for combining and dividing and switching microwave signals comprising:

a rigid, metallic, hollow body having internal walls defining a cavity, a plurality of spaced input and output openings in said body communicating with said cavity for passing said microwave signals into said cavity through said input openings and out of said cavity through said output openings, partition means in said cavity dividing the same into a plurality of passages each extending between one of said input openings and one of said output openings;

support means adjacent said body; and a plurality of movable shorting members carried by said support means, said shorting members being selectively extensible into said passages for effectively closing them against passage of said microwave signals therethrough and selectively retractable from said passages thereby permitting transmission of said microwave signals therethrough between said input openings and said output openings;

so that first microwave signals applied at a first one of said input openings can pass through only a first one of said passages to a first one of said output openings, so that said first microwave signals can be cut off from said first passage and switched to pass through only a second one of said passages to a second one of said output openings, so that said first microwave signals applied at said first input opening can be divided to pass through said first and second passages simultaneously to both said first and second output openings, so that second microwave signals applied at a second one of said input openings can pass through only a third one of said passages to combine with said first microwave signals if present at said first output opening, so that said second microwave signals applied at said second input opening can be cut off from said third passage and switched to pass through only a fourth one of said passages to combine with said first microwave signals at said second output opening if present at said second output opening, so that said second microwave signals applied at said second input opening, can be divided to pass through both said third and fourth passages simultaneously to said first and second output openings, and so that said second microwave signals at said first and second output openings can combine with said first microwave signals if present thereat.

2. A microwave transfer device as defined in claim 1, further comprising motive means on said support means operatively arranged to reciprocate said shorting members selectively.

3. A microwave transfer device as defined in claim 1 wherein each of said shorting members is a pin movable axially transversely of one of said passages.

4. A microwave transfer device as defined in claim 3, further comprising a plurality of dielectric members at sides of said passages, each of said members facing an end of one of said pins to serve as an abutment for said end of said pin when said pin is fully extended into one of said passages.

5. A microwave transfer device as defined in claim 2, wherein said partition means is a post having curved sides opposing said internal walls to define sides of said passages.

6. A microwave transfer device as defined in claim 2 wherein all of said openings are of equal size and all of said passages are equal in length and cross sectional area, to present said microwave signals with equal impedance at said openings and in said passages.

7. A microwave transfer device as defined in claim 2, wherein said motive means is electrically driven to extend and retract said shorting members selectively.

8. A microwave transfer device as defined in claim 6, wherein each of said shorting members is a pin moveable axially transversely of one of said passages.

9. A microwave transfer device as defined in claim 8, wherein said partition means is a post having smooth curved sides opposing said internal walls which are also smooth and curved so that said passages provide paths of minimum impedance for said microwave signals in said passages.

10. A microwave transfer device as defined in claim 9, further comprising a plurality of dielectric members at sides of said passages, each of said dielectric members facing an end of one of said shorting members, to serve as an abutment for said end of said shorting member, when said shorting member is fully extended in one of said passages.

* * * * *